US007545330B2

(12) United States Patent
Sakurai et al.

(10) Patent No.: US 7,545,330 B2
(45) Date of Patent: Jun. 9, 2009

(54) ANTENNA DEVICE INCLUDING SURFACE-MOUNTED ELEMENT

(75) Inventors: Minoru Sakurai, Tokyo (JP); Yusuke Miura, Tokyo (JP); Hirotake Sumi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/949,866

(22) Filed: Dec. 4, 2007

(65) Prior Publication Data

US 2008/0129605 A1 Jun. 5, 2008

(30) Foreign Application Priority Data

Dec. 4, 2006 (JP) ..... 2006-326854
Jun. 28, 2007 (JP) ..... 2007-170761

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS 6,501,425 B1 * 12/2002 Nagumo et al. ..... 343/700 MS
6,545,640 B1 * 4/2003 Herve et al. ..... 343/700 MS
6,995,711 B2 * 2/2006 Killen et al. ..... 343/700 MS

FOREIGN PATENT DOCUMENTS

JP 2003-198239 A 7/2003

* cited by examiner

*Primary Examiner*—Rexford Barnie
*Assistant Examiner*—Jason Crawford
(74) *Attorney, Agent, or Firm*—Frishauf, Holtz, Goodman & Chick, P.C.

(57) ABSTRACT

An antenna device having a first material base and a second material base is provided. The first material base is three-dimensionally formed by first dielectric material. The first material base forms an opening inside, and has an antenna element arranged on a surface of the first material base. The second material base is formed by second dielectric material of relative permittivity higher than relative permittivity of the first dielectric material. The second material base is arranged in the opening of the first material base.

18 Claims, 11 Drawing Sheets

ANTENNA DEVICE INCLUDING SURFACE-MOUNTED ELEMENT

CROSS REFERENCE TO RELATED APPLICATIONS

This application is based upon and claims the benefit of priority from the prior Japanese Patent Applications No. 2006-326854 filed on Dec. 4, 2006 and No. 2007-170761 filed on Jun. 28, 2007; the entire contents of which are incorporated herein by reference.

BACKGROUND OF THE INVENTION

1. Field of the Invention

The present invention relates to an antenna device including a surface-mounted element, and in particular to an antenna device which may be built into a radio apparatus.

2. Description of the Related Art

A surface-mounted antenna device is known which is formed by an antenna element mounted on a surface of a dielectric material base. The surface-mounted antenna device may be directly mounted on a housing or a printed circuit board of a small-sized radio apparatus such as a mobile phone, and may be used as a built-in antenna. The surface-mounted antenna device may be called a molded inter-connect device (MID) antenna due to a characteristic shape.

In some cases, an attempt is made to downsize the surface-mounted antenna device where relative permittivity of a dielectric material base of the antenna device may produce a wavelength shortening effect. Meanwhile, the surface-mounted antenna device is required to cover a broad frequency range, which is known to be hardly compatible with downsizing in general. Attempts have been made to cope with both of the above requirements which are generally considered to conflict with each other, as disclosed in Japanese Patent Publication of Unexamined Applications (Kokai), No. 2003-198239.

More specifically, a surface-mounted antenna device disclosed in JP 2003-198239 has a radiation electrode (antenna element) arranged on an upper face of a dielectric material base which is bridge-like shaped by removing a portion of a lower face to arrange a concave portion on the lower face. It is described in JP 2003-198239 that the bridge-like shape may be aligned in a way that balance between radiation efficiency and frequency range characteristics is considered. It is also described in JP 2003-198239 that the surface-mounted antenna device may be modified to have additional piece of dielectric material of relative permittivity different from relative permittivity of the dielectric material base loaded on the concave portion of the lower face.

For being loaded on the concave portion of the lower face of the dielectric material base, the additional dielectric material shall be selected in terms of mechanical characteristics, e.g., requiring adhesiveness so as to be applied to structure of the antenna device of JP 2003-198239. Besides, it is difficult for the antenna device of JP 2003-198239 to be made multiple-frequency resonant by having plural pieces of dielectric material of relative permittivity different one another loaded.

SUMMARY OF THE INVENTION

Accordingly, an object of the present invention is to provide an antenna device that may be downsized and made multiple-frequency resonant without much degradation of performances such as frequency range characteristics or radiation efficiency.

To achieve the above object, according to one aspect of the present invention, an antenna device having a first material base and a second material base is provided. The first material base is three-dimensionally formed by first dielectric material. The first material base forms an opening inside, and has an antenna element arranged on a surface of the first material base. The second material base is formed by second dielectric material of relative permittivity higher than relative permittivity of the first dielectric material. The second material base is arranged in the opening of the first material base.

DETAILED DESCRIPTION OF THE INVENTION

Figure 1:
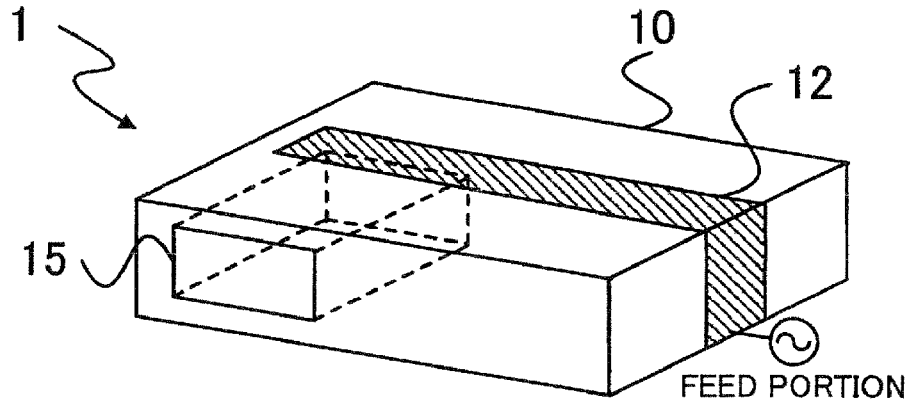
FIG. 1 is a perspective view of an antenna device of a first embodiment of the present invention.

Hereinafter, embodiments of the present invention will be described in detail. In following descriptions, terms like upper, lower, left, right, horizontal or vertical used while referring to a drawing shall be interpreted on a page of the drawing unless otherwise noted. Besides, a same reference numeral given in no less than two drawings shall represent a same member or a same portion.

A first embodiment of the present invention will be described with reference to FIGS. 1-6. FIG. 1 is a perspective view of an antenna device 1 of the first embodiment to show a configuration of the antenna device 1. The antenna device 1 is formed by having a first material base 10 and a second material base 15 both of which are made of dielectric material having relative permittivity values different from each other. Assume that the relative permittivity of the dielectric material of the second material base 15 is higher than the relative permittivity of the dielectric material of the first material base 10.

On a surface of the first material base 10, an antenna element 12 made of conductive material is plated or stuck. A lower end of the antenna element 12 becomes a feed portion if the antenna device 1 is mounted in a housing of a radio apparatus (not shown) or on a circuit board (not shown). An upper end of the antenna element 12 is open-ended.

Figure 2:
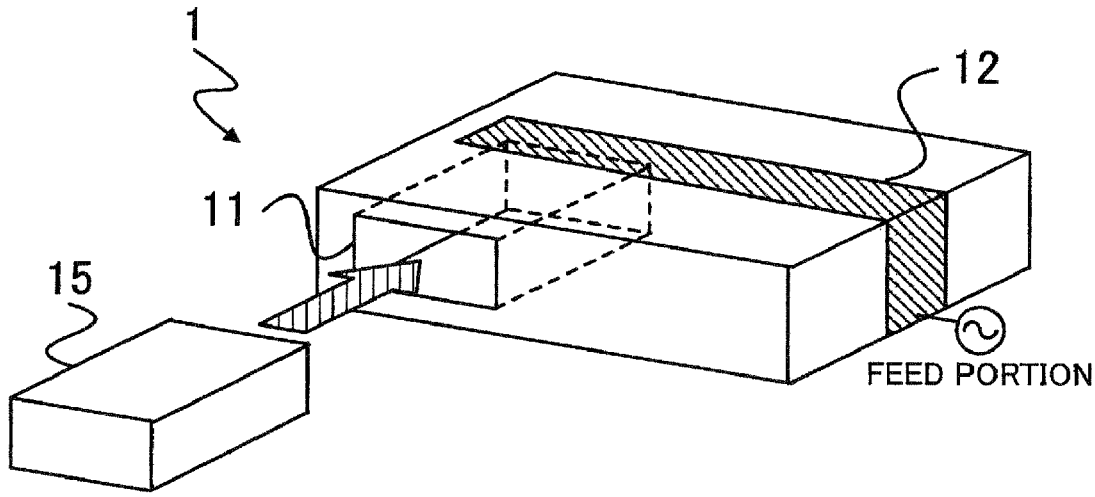
FIG. 2 is an assembly diagram of the antenna device of the first embodiment.

FIG. 2 is an assembly diagram of the antenna device 1 to show the configuration with an example of how to assemble the antenna device 1. The first material base 10 is of a three-dimensional shape forming an opening 11 inside. The opening 11 is shaped in a way that a portion of the first material base 10 is removed to outside (the portion that would fill the opening 11 may not be actually removed in a manufacturing process of the first material base 10). The second material base 15 is arranged in a way to be inserted into the opening 11 from outside.

Consequently, as shown in FIG. 1, the second material base 15 is arranged close to the open end of the antenna element 12. As the relative permittivity of the dielectric material of the second material base 15 is higher than the relative permittivity of the dielectric material of the first material base 10, the relative permittivity around the open end of the antenna element 12 is higher than the relative permittivity around other portions of the antenna element 12.

Figure 3:
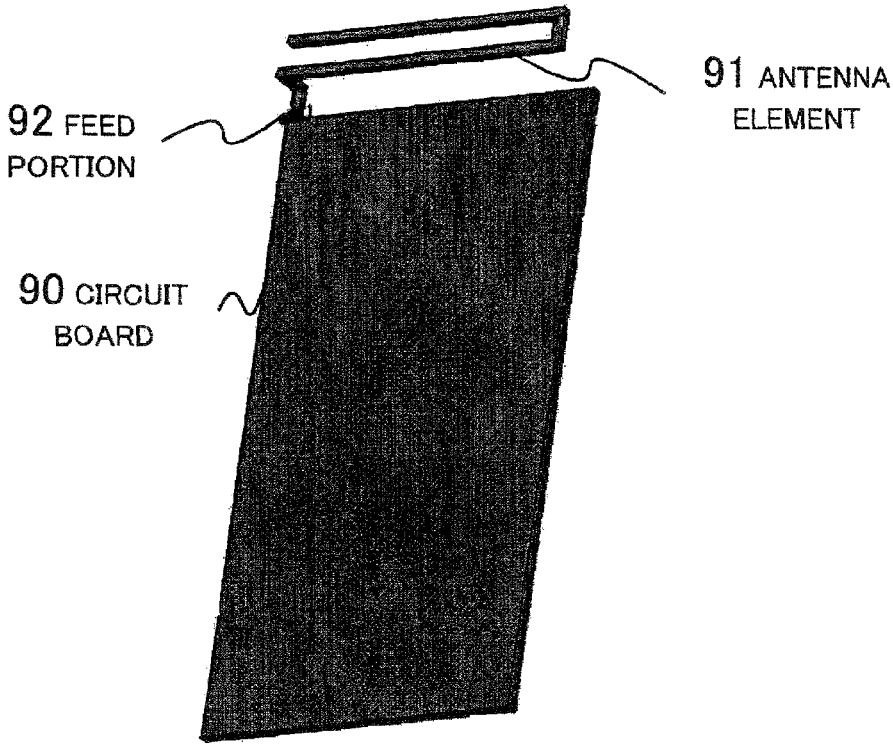
FIG. 3 is an explanatory diagram to show a condition of simulation for a model of the antenna device of the first embodiment regarding a location of an antenna element of the model.
Figure 4:
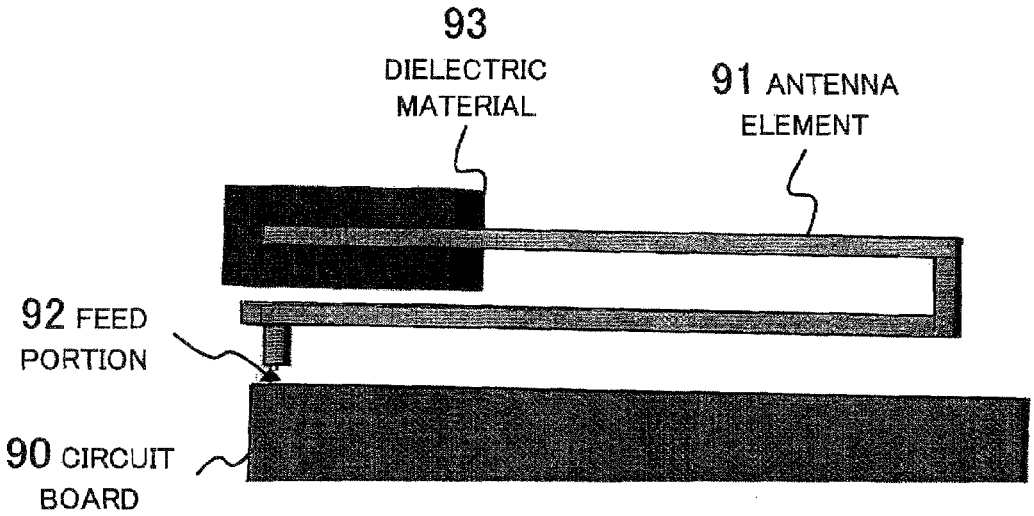
FIG. 4 is an explanatory diagram to show a condition of the simulation regarding how and where the antenna element of the model is loaded with dielectric material.

An effect of arranging the second material base 15 close to the open end of the antenna element 12 will be described with reference to FIGS. 3-6. FIG. 3 and FIG. 4 are explanatory diagrams to show conditions of simulation for estimating to which portion of an antenna element a piece of dielectric material should be loaded.

In the simulation, as shown in FIG. 3, it is assumed that an antenna element 91 is arranged on an end of a circuit board 90. The simulation is aimed at evaluating a configuration of the present invention, where relative permittivity around a portion of an antenna element is raised. A model simulating the above configuration is formed by the antenna element 91 at least a portion of which is loaded with a piece of dielectric material as explained later with reference to FIG. 4. In the simulation, it is assumed that a frequency of an L-band is used, that a long side of the circuit board 90 is about one-third wavelength long, and that a short side of the circuit board 90 is about one-sixth wavelength long.

The antenna element 91 is a monopole type antenna fed at an end connected to the feed portion 92 and having another end being open. The antenna element 91 stands up from the feed portion 92 in a direction parallel to the long side of the circuit board 90 and going away from the upper short side of the circuit board 90. Then, the antenna element 91 rises perpendicular to a face of the circuit board 90, and is further U-shaped, arranged sideways and almost parallel to the short side of the circuit board 90.

FIG. 4 is an explanatory diagram of a configuration where a portion of the antenna element 91 is loaded with a piece of dielectric material 93. Each of portions shown in FIG. 4 given reference numerals 90-92 is a same as the corresponding one shown in FIG. 3. FIG. 4 shows only an end portion of the circuit board 90 where the antenna element 91 is arranged. It is assumed that relative permittivity of the dielectric material 93 values 7.

Figure 5:
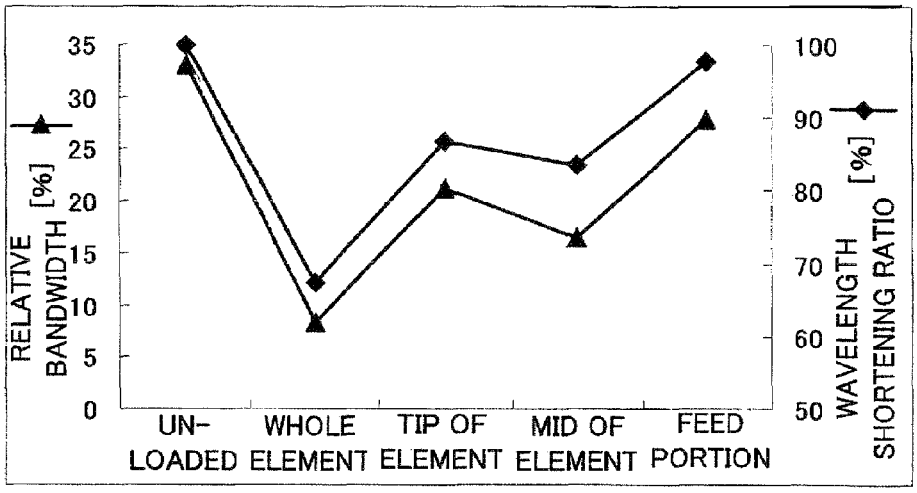
FIG. 5 is a line chart of relative bandwidths and wavelength shortening ratios of the model of the antenna device in separate five cases depending on if and where the antenna element of the model is loaded with the dielectric material.

FIG. 5 is a line chart of relative bandwidths and wavelength shortening ratios of the antenna element 91 estimated by the simulation under conditions shown in FIG. 3 and FIG. 4 and in separate five cases depending on if and where the antenna element 91 is loaded with the dielectric material 93. FIG. 5 has a horizontal axis representing the five cases described above.

On a left-hand side of the horizontal axis, "unloaded" represents a case where the antenna element 91 is loaded with no dielectric material. On a next right of the left-hand side, "whole element" represents a case, which is not shown in FIG. 5, where the antenna element 91 is loaded as a whole with a piece of dielectric material of a greater size than the dielectric material 93 shown in FIG. 4.

On a middle of the horizontal axis, "tip of element" represents a case where the antenna element 91 is loaded with the dielectric material 93 on the tip (open end) of the antenna element 91 as shown in FIG. 4. On a next right of the middle, "mid of element" represents a case, which is not shown in FIG. 5, where the antenna element 91 is loaded with the dielectric material 93 on a middle portion between the tip of the antenna element 91 and a turning portion of the sideways arranged U-shape. On a right-hand side of the horizontal axis, "feed portion" represents a case, which is not shown in FIG. 5, where the antenna element 91 is loaded with the dielectric material 93 on a portion including the end connected to the feed portion 92.

FIG. 5 has a left-hand side vertical axis representing a relative bandwidth of the antenna element 91 in percent, and associated with triangular plots forming one of two lines shown in FIG. 5. FIG. 5 has a right-hand side vertical axis representing a ratio of a wavelength on the antenna element 91 of each of the above cases to a wavelength of the unloaded case (wavelength shortening ratio) in percent, and associated with diamond-shaped plots forming another one of the two lines shown in FIG. 5.

On the two lines shown in FIG. 5 and in the case of "whole element" comparing to the case of "unloaded", although the wavelength shortening ratio reaches no greater than 70 percent, the relative bandwidth decreases from 33 percent to 8 percent. If the case of "tip of element" is compared with the case of "unloaded", the wavelength shortening ratio is around 85 percent, and the relative bandwidth decreases from 33 percent but remains 20 percent.

If the case of "mid of element" is compared with the case of "unloaded", the relative bandwidth decreases from 33 percent to 15 percent, although the wavelength shortening ratio is a little more than 80 percent. If the case of "feed portion" is compared with the case of "unloaded", the wavelength shortening ratio makes no much difference, and the relative bandwidth decreases to no greater than 30 percent.

What is shown in FIG. 5 will be described as generically as possible, as follows. If the "whole element" is loaded with the dielectric material for the wavelength shortening effect, the relative band-width will be sacrificed to some extent. For fairly securing the relative bandwidth without demanding the wavelength shortening effect as much as the case of the "whole element", it is effective that the "tip of element" or the "mid of element" is loaded with the dielectric material.

If the "tip of element" and the "mid of element" are compared with each other, although depending on required values of the wave-length shortening ratio and the relative bandwidth, it is desirable that the "tip of element" is loaded with the dielectric material from a stand-point to shorten the wavelength without sacrificing much of the relative bandwidth. If a tradeoff between the wavelength shortening ratio and the relative bandwidth as described above is applied to the antenna device 1 shown in FIG. 1 or FIG. 2, it is presumably desirable that the second material base 15 is arranged close to the open end of the antenna element 12.

Figure 6:
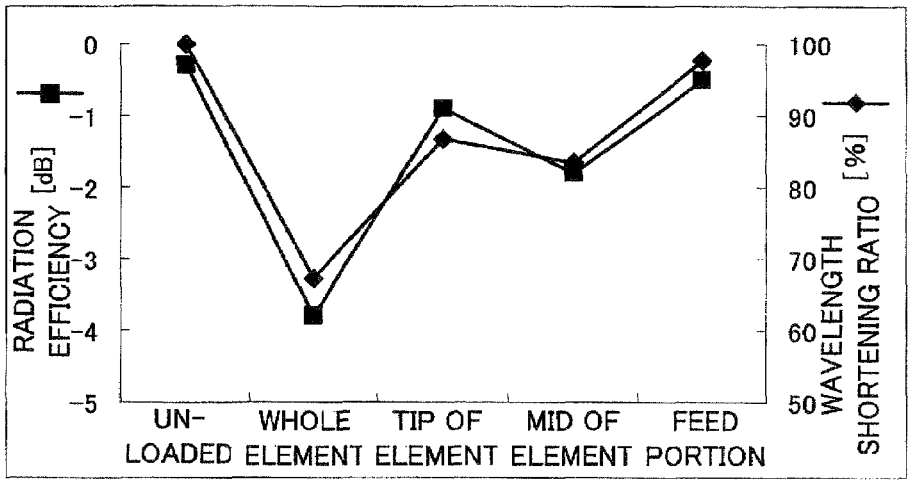
FIG. 6 is a line chart of radiation efficiency and wavelength shortening ratios of the model of the antenna device in the separate five cases depending on if and where the antenna element of the model is loaded with the dielectric material.

FIG. 6 is a line chart of radiation efficiency and wavelength shortening ratios of the antenna element 91 estimated by the simulation under conditions shown in FIG. 3 and FIG. 4 and in separate cases depending on if and where the antenna element 91 is loaded with the dielectric material 93. FIG. 6 has a same horizontal axis as shown in FIG. 5.

FIG. 6 has a left-hand side vertical axis representing the radiation efficiency of the antenna element 91 in decibel (dB) by taking the "unloaded" case as a reference, and associated with larger square plots forming one of two lines shown in FIG. 6. FIG. 6 has the same right-hand side vertical axis as shown in FIG. 5 representing the wavelength shortening ratio and associated with the diamond-shaped plots forming another one of the two lines shown in FIG. 6.

As the line of the wavelength shortening ratio shown in FIG. 6 is the same as shown in FIG. 5, the other of the two lines of the radiation efficiency will be explained as follows. If the case of "whole element" is compared with the case of "unloaded", the radiation efficiency decreases by no less than 3 dB. If the case of "tip of element" is compared with the case of "unloaded", the radiation efficiency decreases by 1 dB but remains there. If the case of "mid of element" is compared with the case of "unloaded", the radiation efficiency decreases by a little less than 2 dB. If the case of "feed portion" is compared with the case of "unloaded", the radiation efficiency makes no much difference.

What is shown in FIG. 6 will be described as generically as possible, as follows. A tradeoff between the wavelength shortening ratio and the radiation efficiency may be considered almost in a same way as the tradeoff between the wavelength shortening ratio and the relative bandwidth as described with reference to FIG. 5. Thus, it is desirable that the "tip of element" is loaded with the dielectric material from a standpoint to shorten the wavelength without sacrificing much of the radiation efficiency. If the tradeoff between the wavelength shortening ratio and the radiation efficiency as described above is applied to the antenna device 1 shown in FIG. 1 or FIG. 2, it is presumably desirable that the second material base 15 is arranged close to the open end of the antenna element 12.

Being configured equivalently to the configuration that the antenna element is loaded around the tip with the dielectric material of relatively high relative permittivity, the antenna device 1 may shorten a wavelength without sacrificing much of the relative bandwidth and the radiation efficiency as an antenna. As the second material base 15 is arranged in a way to be inserted into the opening 11, dielectric material of high relative permittivity being mechanically hard and fragile may even be used as dielectric material of the second material base 15. The dielectric material need not be adhesive, i.e., the second material base 15 may be formed without careful selection of mechanical characteristics.

A modification of the first embodiment will be described with reference to FIG. 7, a perspective view of an antenna device 1*a* modified from the antenna device 1 of the first embodiment. As the antenna device 1*a* is configured to be a same as the antenna device 1 except for an antenna element made of conductive material, each portion of the antenna device 1*a* which is a same as the corresponding one shown in FIG. 1 or FIG. 2 is given a same reference numeral, and its explanation is omitted.

On a surface of the first material base 10 of the antenna device 1*a*, an antenna element 13 and an antenna element 14 made of conductive material are plated or stuck. The antenna element 13 and the antenna element 14 have a feed portion in common, and have resonant frequencies different from each other.

Figure 7:
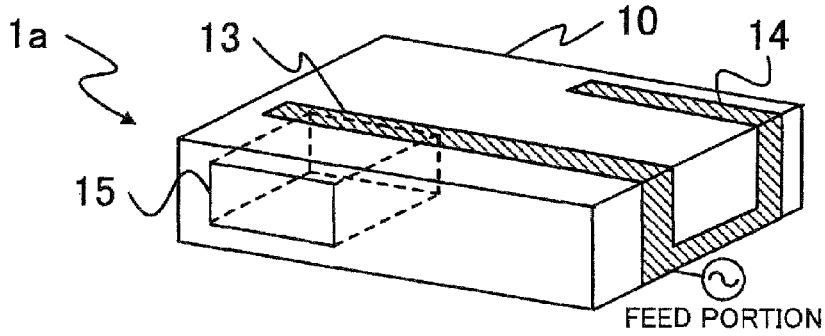
FIG. 7 is a perspective view of an antenna device modified from the antenna device of the first embodiment.

In a configuration of the antenna device 1*a* shown in FIG. 7, the second material base 15 may contribute to wavelength shortening of the resonant frequency of the antenna element 13 as being arranged close to an open end of the antenna element 13. The second material base 15 may not give a wavelength shortening effect to the antenna element 14, however, as being apart from the antenna element 14. That is, the antenna device 1*a* configure to be multiple-frequency resonant may select if the wavelength is shortened or not for each of the resonant frequencies separately.

According to the first embodiment of the present invention described above, the antenna device including a surface-mounted element may be formed by an assembly of plural material bases of relative permittivity different from each other, and may be downsized without sacrificing much of the performance of the relative bandwidth and the radiation efficiency thereby.

A second embodiment of the present invention will be described with reference to FIG. 8, a perspective view of an antenna device 2 of the second embodiment to show a configuration with an example of how to assemble the antenna device 2. The antenna device 2 is formed by having a first material base 20 made of dielectric material. On a surface of the first material base 20, an antenna element 23 and an antenna element 24 are plated or stuck. The antenna element 23 and the antenna element 24 have a feed portion in common and have resonant frequencies different from each other, as the antenna elements 13 and 14 shown in FIG. 7 do.

The first material base 20 is of a three-dimensional shape forming an opening 21*a* and an opening 21*b* inside. Each of the opening 21*a* and the opening 21*b* is shaped in a way that a portion of the first material base 20 is removed to outside (the portion that would fill the opening 21*a* or 21*b*, however, may not be actually removed in a manufacturing process of the first material base 20). The antenna device 2 is configured that a second material base 25 is arranged in a way to be inserted into the opening 21*a* from outside, and a third material base 26 is arranged in a way to be inserted into the opening 21*b* from outside.

Assume that relative permittivity of dielectric material of the second material base 25 is higher than relative permittivity of dielectric material of the first material base 20, and that relative permittivity of dielectric material of the third material base 26 is higher than the relative permittivity of the dielectric material of the first material base 20. Assume that the dielectric material of the second material base 25 and the dielectric material of the third material base 26 have relative permittivity values different from each other.

Figure 8:
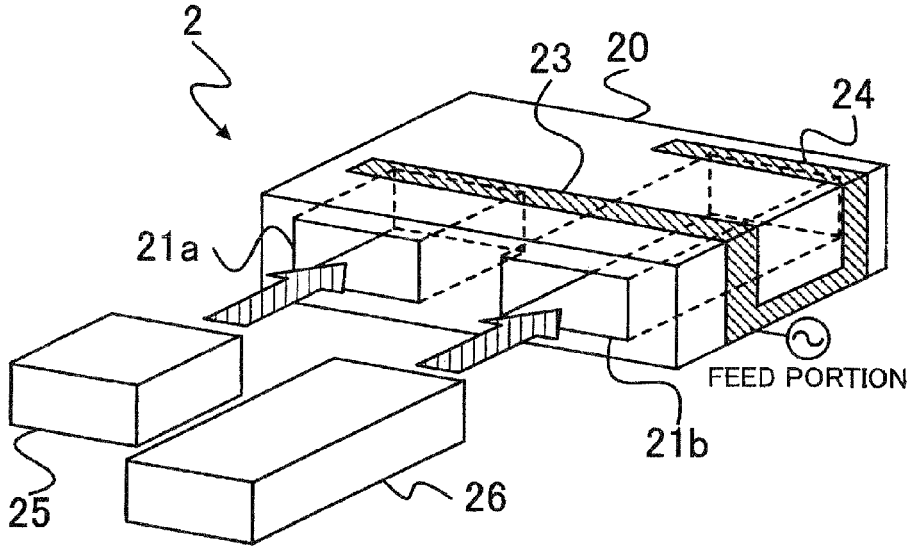
FIG. 8 is a perspective view of an antenna device of a second embodiment of the present invention.

In a configuration of the antenna device 20 shown in FIG. 8, the second material base 25 is arranged close to an open end of the antenna element 23 and the relative permittivity of the second material base 25 may contribute to wavelength shortening of the resonant frequency of the antenna element 23. The relative permittivity of the second material base 25 may not give a wavelength shortening effect to the antenna element 24, however, which is arranged apart from the second material base 25. The antenna element 23 is, as being arranged also close to the third material base 26 at a middle portion between an open end and a feed portion, given a wavelength shortening effect caused by the second material base 25 and a wavelength shortening effect caused by the third material base 26 in a complex way. The antenna element 24 is, as being arranged close to the third material base 26 at an open end, given a wavelength shortening effect caused by the third material base 26.

A first modification of the second embodiment will be described with reference to FIG. 9, a perspective view of an antenna device 2*a* firstly modified from the antenna device 2 of the second embodiment to show a configuration with an example of how to assemble the antenna device 2*a*. Each of portions of the antenna device 2*a* being a same as the corresponding one of the antenna device 2 is given a same reference numeral as shown in FIG. 8.

The antenna device 2*a* is formed by having a first material base 20*a* made of dielectric material. On a surface of the first material base 20*a*, the antenna element 23 and the antenna element 24 which are same as shown in FIG. 8 are plated or stuck. The first material base 20*a* forms the opening 21*a* inside which is the same as shown in FIG. 8, and the second material base 25 which is the same as shown in FIG. 8 arranged in a way to be inserted from outside.

On a face (a back face, e.g., in FIG. 9) of the first material base 20*a* other than a face (a front face, e.g., in FIG. 9) from which a portion that would fill the opening 21*a* has been removed, an opening 21*c* is formed in a way that a portion that would fill the opening 21*c* has been removed (the portion that would fill the opening 21*a* or 21*c*, however, may not be actually removed in a manufacturing process of the first material base 20*a*). The antenna device 2*a* is configured that the second material base 25 is arranged in a way to be inserted into the opening 21 a from one face (the front face, e.g., in FIG. 9) of the first material base 25, and a third material base 27 is arranged in a way to be inserted into the opening 21*c* from another face (the back face, e.g., in FIG. 9) of the first material base 25.

Assume that relative permittivity of dielectric material of the second material base 25 is higher than relative permittivity of dielectric material of the first material base 20*a*, and that relative permittivity of dielectric material of the third material base 27 is higher than the relative permittivity of the dielectric material of the first material base 20*a*. Assume that the dielectric material of the second material base 25 and the dielectric material of the third material base 27 have relative permittivity values different from each other.

Figure 9:
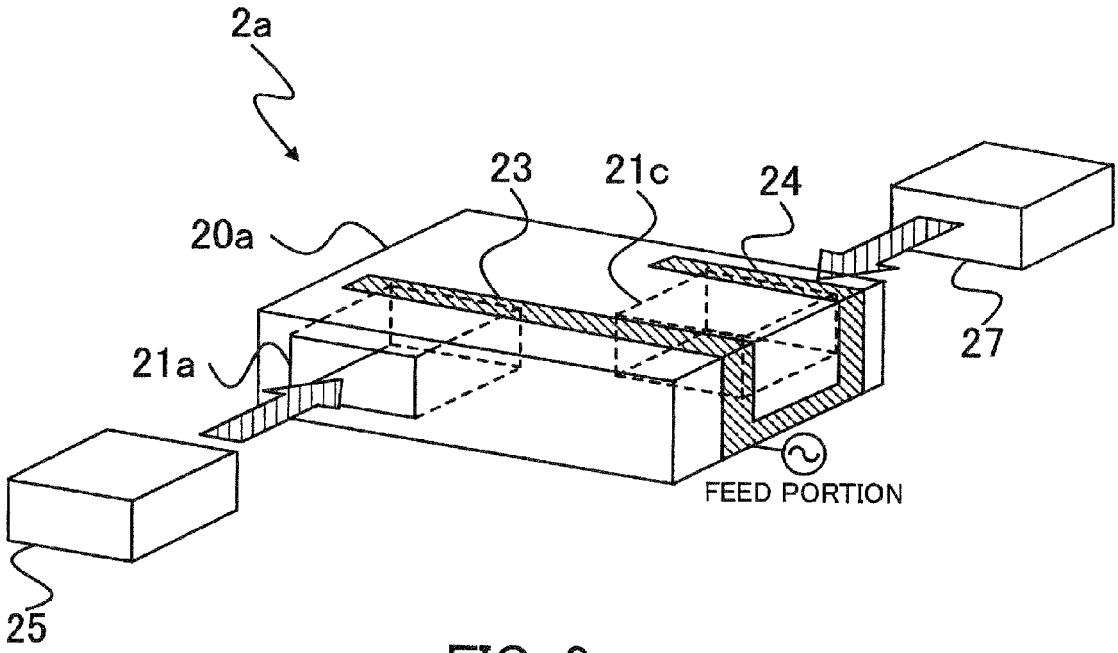
FIG. 9 is a perspective view of an antenna device firstly modified from the antenna device of the second embodiment.

In a configuration of the antenna device 20*a* shown in FIG. 9, the second material base 25 is arranged close to the open end of the antenna element 23 and may contribute to wavelength shortening of the resonant frequency of the antenna element 23. The antenna element 24 arranged apart from the second material base 25, however, may not be given a wavelength shortening effect caused by the relative permittivity of the second material base 25.

Meanwhile, the third material base 27 is arranged close to the open end of the antenna element 24 and may contribute to wave-length shortening of the resonant frequency of the antenna element 24. The antenna element 23 arranged apart from the third material base 27, however, may not be given a wavelength shortening effect caused by the relative permittivity of the third material base 27. Thus, as each of the antenna element 23 and the antenna element 24 is given a wavelength shortening effect separately, a degree of freedom for designing the antenna device 2*a* may be improved.

Figure 10:
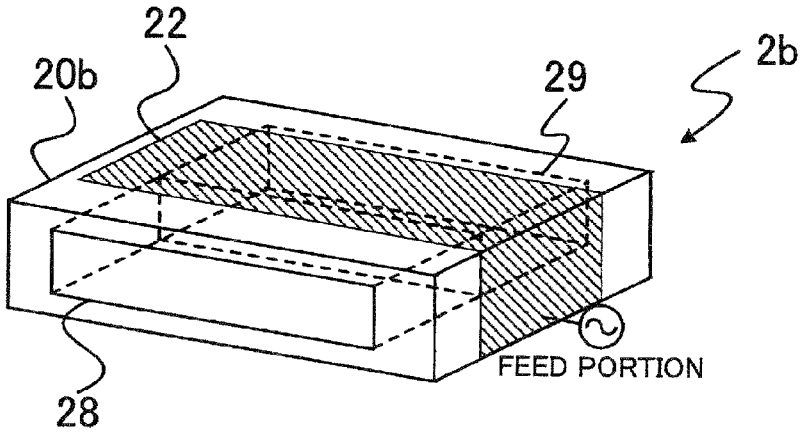
FIG. 10 is a perspective view of an antenna device secondly modified from the antenna device of the second embodiment.

A second modification of the second embodiment will be described with reference to FIG. 10, a perspective view of an antenna device 2*b* secondly modified from the antenna device 2 of the second embodiment to show a configuration of the antenna device 2*b*. The antenna device 2*b* is formed by a first material base 20*b*, a second material base 28 and a third material base 29 each of which is made of dielectric material of relative permittivity different from one another.

The second material base 28 and the third material base 29 are arranged in a way to be inserted into an opening formed inside the first material base 20*b*, as in the way of the previous embodiments and modifications except that the two (second and third) material bases 28 and 29 are arranged in the single opening.

Assume that relative permittivity of dielectric material of the second material base 28 is higher than relative permittivity of dielectric material of the first material base 20*b*, and that relative permittivity of dielectric material of the third material base 29 is higher than the relative permittivity of the dielectric material of the first material base 20*b*. Assume that the dielectric material of the second material base 28 and the dielectric material of the third material base 29 have relative permittivity values different from each other.

On a surface of the first material base 20*b*, an antenna element 22 made of conductive material is plated or stuck. A lower end of the antenna element 22 becomes a feed portion if the antenna device 2*b* is mounted in a housing of a radio apparatus (not shown) or on a circuit board (not shown). An upper end of the antenna element 22 is open-ended. Being shaped as shown in FIG. 10, the antenna element 22 is arranged in a way that a portion of the antenna element 22 is close to the second material base 28 and another portion of the antenna element 22 is close to the third material base 29.

In a configuration of the antenna device 2*b* as described above, a voltage or a current of a wavelength shortened by the relative permittivity of the second material base 28 is distributed on a portion of the antenna element 22 close to the second material base 28, and a voltage or a current of a wavelength shortened by the relative permittivity of the third material base 29 is distributed on a portion of the antenna element 22 close to the third material base 29. That is, the antenna element 22 is a single element but may work as a dual resonant antenna element.

According to the second embodiment of the present invention described above, the antenna device including a surface-mounted element may be formed by an assembly of plural material bases of relative permittivity different from one another so as to be given wave-length shortening effects for multiple resonant frequencies.

Figure 11:
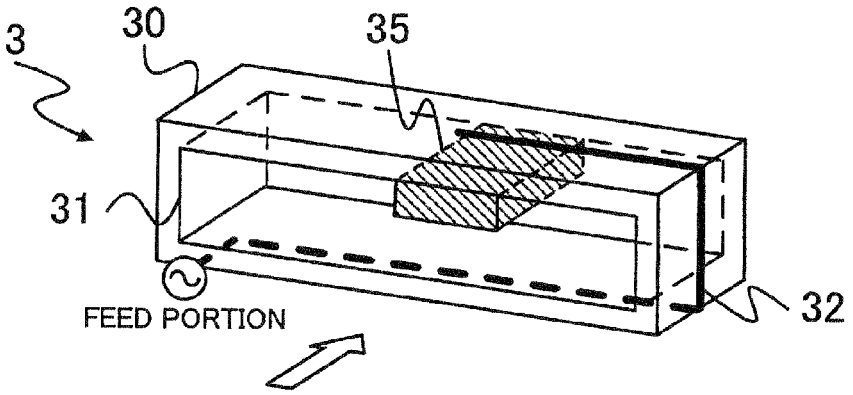
FIG. 11 is a perspective view of an antenna device of a third embodiment of the present invention, where the antenna device has a first material base and a second material base of relative permittivity different from each other, and on the first material base an antenna element is plated or stuck.

A third embodiment of the present invention will be described with reference to FIGS. 11-26. FIG. 11 is a perspective view of an antenna device 3 of the third embodiment to show a configuration of the antenna device 3.

The antenna device 3 has a first material base 30. The first material base 30 is of a three-dimensional shape forming an opening 31 inside which is shaped in a way that a portion of dielectric material is removed to outside (the portion that would fill the opening 31, however, may not be actually removed in a manufacturing process of the first material base 30).

On an outer surface of the first material base 30, an antenna element 32 made of conductive material is plated or stuck. A lower end of the antenna element 32 becomes a feed portion if the antenna device 3 is mounted in a housing of a radio apparatus (not shown) or on a circuit board (not shown). An upper end of the antenna element 32 is open-ended. A portion of the antenna element 32 which is actually invisible in FIG. 11 is drawn by a dashed line.

The antenna element 32 may form but not limited to a monopole antenna, e.g., and may form a portion of a dipole antenna instead. The antenna element 32 may be variously modified as to a line width, a shape, whether a portion is short-circuited or not, depending on a design of the antenna device 3.

The antenna device 3 has a second material base 35 made of dielectric material of relative permittivity which is higher than relative permittivity of the first material base 30. The second material base 35 is arranged somewhere in the opening 31 close to at least a portion selected from a whole path of the antenna element 32 which is arranged along the outer face of the first material base 30. Another material base (not shown) made of dielectric material of relatively low relative permittivity may be arranged in a space of the opening 31 other than the second material base 35. The opening 31 may be properly partitioned.

Figure 12A:
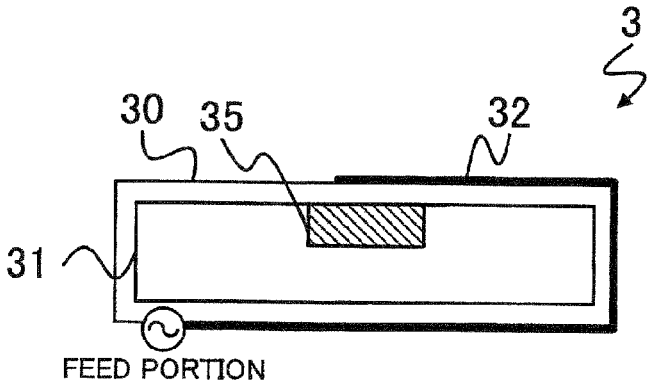
FIGS. 12A and 12B are a front view and a right side view, respectively, of the antenna device of the third embodiment.
Figure 12B:
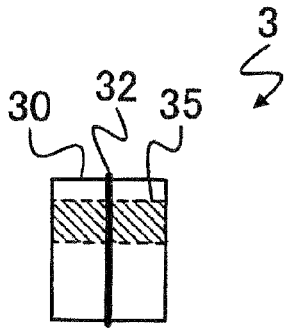

FIG. 12A is a front view of the antenna device 3 from a viewpoint indicated by a block arrow shown in FIG. 11. FIG. 12B is a right side view of the antenna device 3. As shown in FIGS. 11, 12A and 12B, the second material base 35 is arranged close to the open end of the antenna element 32 by, e.g., being stuck to an upper face of the opening 31. The second material base 35 may be arranged not only around the open end of the antenna element 32 but around another selected portion of the antenna element 32.

Figure 13:
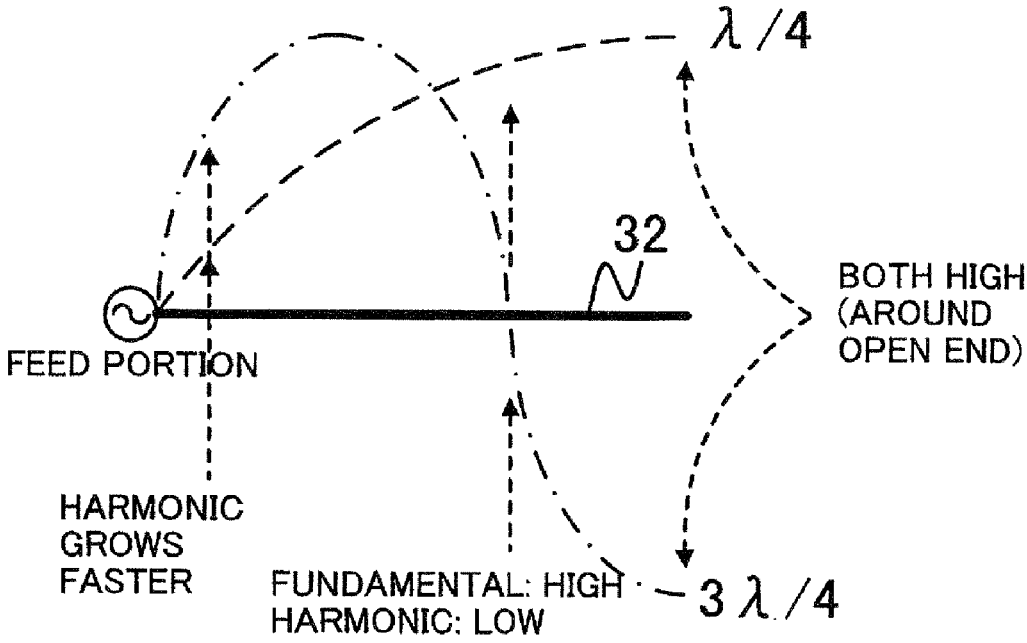
FIG. 13 is an explanatory diagram to show electric field strength distribution on the antenna element of the antenna device of the third embodiment.

FIG. 13 is an explanatory diagram to show, in a simplified manner, electric field strength distribution on the antenna element 32 which is being excited. In FIG. 13, the antenna element 32 is depicted as a single straight line without regard to a mechanical shape of the antenna element 32 for convenience of explanation. A dashed line designated by "λ/4" represents electric field strength distribution of a fundamental wave of the antenna element 32, where a quarter wavelength of the fundamental wave corresponds to a whole length of the antenna element 32. A dot-and-dash line designated by "3λ/4" represents electric field strength distribution of a harmonic wave of the antenna element 32, where a three-quarter wavelength of the harmonic wave corresponds to a whole length of the antenna element 32.

Around the open end of the antenna element 32, as shown in FIG. 13, the fundamental wave and the harmonic wave both show high electric field strength. Around the feed portion of the antenna element 32, however, the electric field strength of the harmonic wave grows faster than the electric field strength of the fundamental wave. Around a portion distant by two-thirds of the whole length from the feed portion, the electric field strength of the harmonic wave is low and the electric field strength of the fundamental wave is high.

In a case where an antenna element is loaded with dielectric material nearby for a wavelength shortening effect, it is more effective to load near a portion of the antenna element of relatively higher electric field strength. Thus, it may be selected which portion of the antenna element 32 the second material base 35 is arranged close to so that either one or both of the fundamental wave and the harmonic wave is selectively given the wavelength shortening effect. The effect may be finer-tuned by selection of relative permittivity values of the first material base 30 and the second material base 35.

Figure 14:
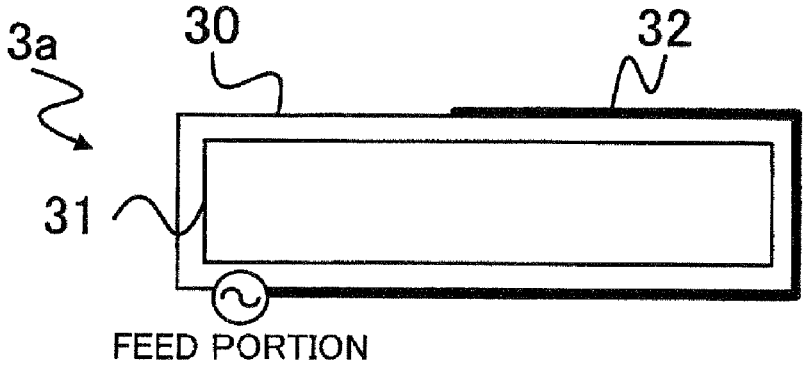
FIG. 14 is a front view of an antenna device modified by removal of the second material base from the antenna device of the third embodiment.

The above selective effect of wavelength shortening will be described with reference to FIGS. 14-26. FIG. 14 is a front view of an antenna device 3*a* modified by removal of the second material base 35 from the antenna device 3 to show a configuration of the antenna device 3*a* as in FIG. 12A. Each of portions of the antenna device 3*a* which is a same as the corresponding one of the antenna device 3 is given a same reference numeral.

Figure 15:
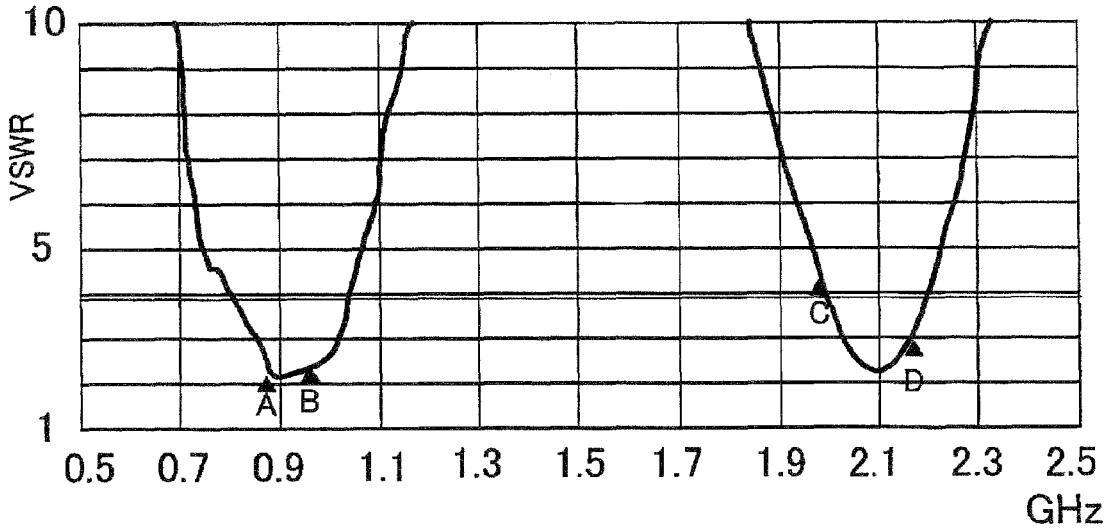
FIG. 15 is a chart of a voltage standing wave ratio (VSWR) vs. frequency characteristic of the antenna device shown in FIG. 14.

FIG. 15 is a chart of a frequency characteristic of a voltage standing wave ratio (VSWR) measured at a feed portion of the antenna device 3*a*. The first material base 30 of a model of the antenna device 3*a* used for the measurement has a size that may be arranged to an end of a circuit board of a mobile phone, and has relative permittivity of 3.8.

FIG. 15 has a vertical axis representing the VSWR, and a horizontal axis representing the frequency in gigahertz (GHz). Assume that the antenna device 3*a* is required to have the VSWR no greater than four (not above a double line shown in FIG. 15) in a frequency range being aimed at. These conditions will also be applied in common to charts of VSWR frequency characteristics hereafter.

In FIG. 15, upper and lower limits of frequency ranges being aimed at are indicated by four markers. A marker "A" (880 megahertz (MHz)) of a lowest frequency represents a lower limit frequency of a mobile communication system mainly used in Europe and Asia, called Global System for Mobile Communications (GSM). A marker "B" (960 MHz) represents a higher limit frequency of the GSM.

A marker "C" (1977 MHz) represents a lower limit frequency of a system based on a European standard for third generation mobile communications, called Universal Mobile Telecommunications System (UMTS). A marker "D" (2167 MHz) represents a higher limit frequency of the UMTS.

In FIG. 15, a curve plotted in a 0.9 GHz band represents a resonance characteristic of a fundamental wave excited on the antenna element 32 of the antenna device 3*a*. As the VSWR values no greater than four in the frequency range for the GSM separated by the marker A and the marker B, the antenna device 3*a* satisfies the condition required to an antenna used for the GSM.

In FIG. 15, a curve plotted in a 2.1 GHz band represents a resonance characteristic of a harmonic wave of the antenna element 32, where a three-quarter wavelength of the harmonic wave corresponds to the whole length of the antenna element 32. As the VSWR values greater than four in the range separated by the marker C and the marker d, particularly on a side closer to the marker C, the antenna device 3*a* does not satisfy the condition required to an antenna used for the UMTS.

Figure 16:
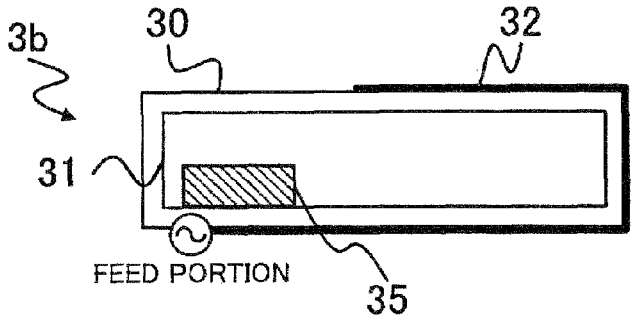
FIG. 16 is a front view of an antenna device modified from the antenna device of the third embodiment by having the second material base moved close to a feed portion of the antenna element of the third embodiment.

FIG. 16 is a front view of an antenna device 3*b* to show a configuration of the antenna device 3*b* as in FIG. 12A. The antenna device 3*b* has been modified from the antenna device 3 by having the second material base 35 moved close to the feed portion of the antenna element 32. Each of portions of the antenna device 3*b* which is a same as the corresponding one of the antenna device 3 is given a same reference numeral.

Figure 17:
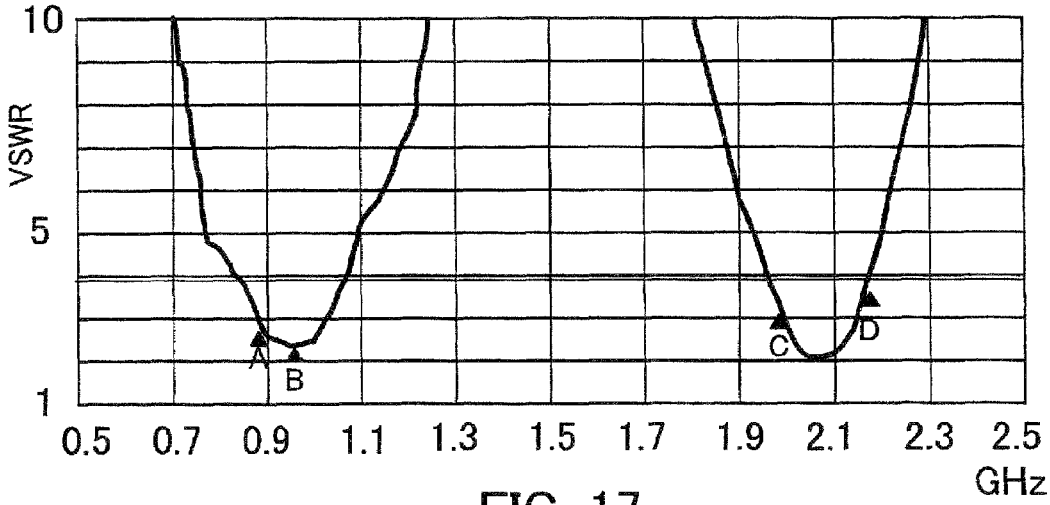
FIG. 17 is a chart of a VSWR vs. frequency characteristic of the antenna device shown in FIG. 16.

FIG. 17 is a chart of a frequency characteristic of a VSWR measured at a feed portion of the antenna device 3*b*. The first material base 30 of a model of the antenna device 3*b* used for the measurement is the same as used for the model of the antenna device 3*a* described above. The second material base 35 of the model of the antenna device 3*b* used for the measurement has relative permittivity of 6.

In FIG. 17, shown are the markers A, B, C and D which are the same as shown in FIG. 15. As the VSWR values no greater than four in the frequency range for the GSM separated by the marker A and the marker B, the antenna device 3*b* satisfies the condition required to an antenna used for the GSM. As the VSWR values no greater than four in the frequency range for the UMTS separated by the marker C and the marker D, the antenna device 3*b* satisfies the condition required to an antenna used for the UMTS.

Although satisfying the condition required to an antenna used for the GSM at the resonant frequency of the fundamental wave of the antenna element 32, the antenna device 32*a* without the second material base 35 does not satisfy the condition required to an antenna used for the UMTS at the resonant frequency of the harmonic wave. Meanwhile, the antenna device 3*b* may improve the characteristic of the harmonic wave without changing much of the characteristic of the fundamental wave by arranging the second material base 35 close to the feed portion, where loading dielectric material of high permittivity affects the harmonic wave more strongly than the fundamental wave.

Figure 18:
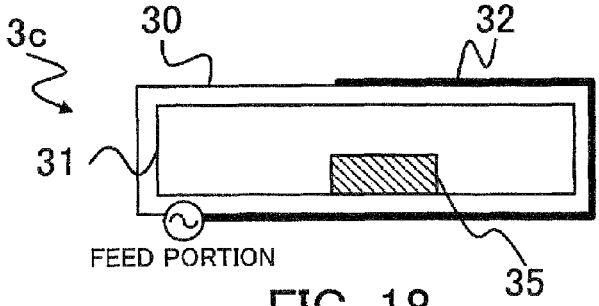
FIG. 18 is a front view of an antenna device modified from the antenna device of the third embodiment by having the second material base moved close to a middle portion of the first material base.

FIG. 18 is a front view of an antenna device 3*c* to show a configuration of the antenna device 3*c* as in FIG. 12A. The antenna device 3*c* has been modified from the antenna device 3 by having the second material base 35 moved close to a middle portion in a horizontal direction of the first material base 30 of the antenna element 32. Each of portions of the antenna device 3*c* which is a same as the corresponding one of the antenna device 3 is given a same reference numeral.

Figure 19:
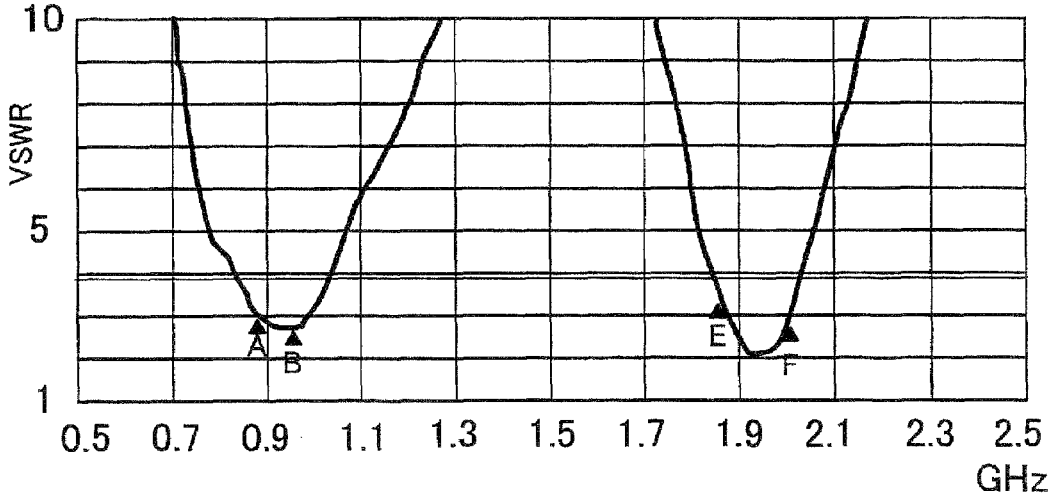
FIG. 19 is a chart of a VSWR vs. frequency characteristic of the antenna device shown in FIG. 18.

FIG. 19 is a chart of a frequency characteristic of a VSWR measured at a feed portion of the antenna device 3*c*. The first material base 30 of a model of the antenna device 3*c* used for the measurement is the same as used for the model of the antenna device 3*a* described above. The second material base 35 of the model of the antenna device 3*c* used for the measurement has relative permittivity of 22.

In FIG. 19, shown are the markers A and B which are the same as shown in FIG. 15, and two additional markers "E" and "F". The marker E (1850 MHz) represents a lower limit frequency of a mobile communication system mainly used in North America, called Personal Communication Services (PCS). The marker F (1990 MHz) represents a lower limit frequency of the PCS.

As the VSWR values no greater than four in the frequency range for the GSM separated by the marker A and the marker B, the antenna device 3*c* satisfies the condition required to an antenna used for the GSM. As the VSWR values no greater than four in the frequency range for the PCS separated by the marker E and the marker F, the antenna device 3*c* satisfies the condition required to an antenna used for the PCS.

The antenna device 3*c* may tune the harmonic wave characteristic to the system (the PCS) different from the UMTS while keeping the fundamental wave characteristic tuned to the GSM by selecting a location and a permittivity value of the second material base 35.

Figure 20:
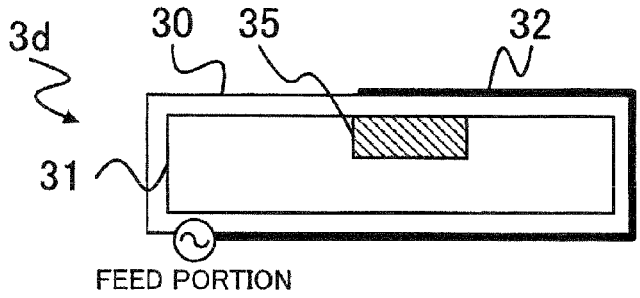
FIG. 20 is a front view of an antenna device modified from the antenna device of the third embodiment by having the second material base moved close to an open end of the antenna element.

FIG. 20 is a front view of an antenna device 3*d* to show a configuration of the antenna device 3*d* as in FIG. 12A. The antenna device 3*d* has been modified from the antenna device 3 by having the second material base 35 moved close to the open end of the antenna element 32. Each of portions of the antenna device 3*d* which is a same as the corresponding one of the antenna device 3 is given a same reference numeral.

Figure 21:
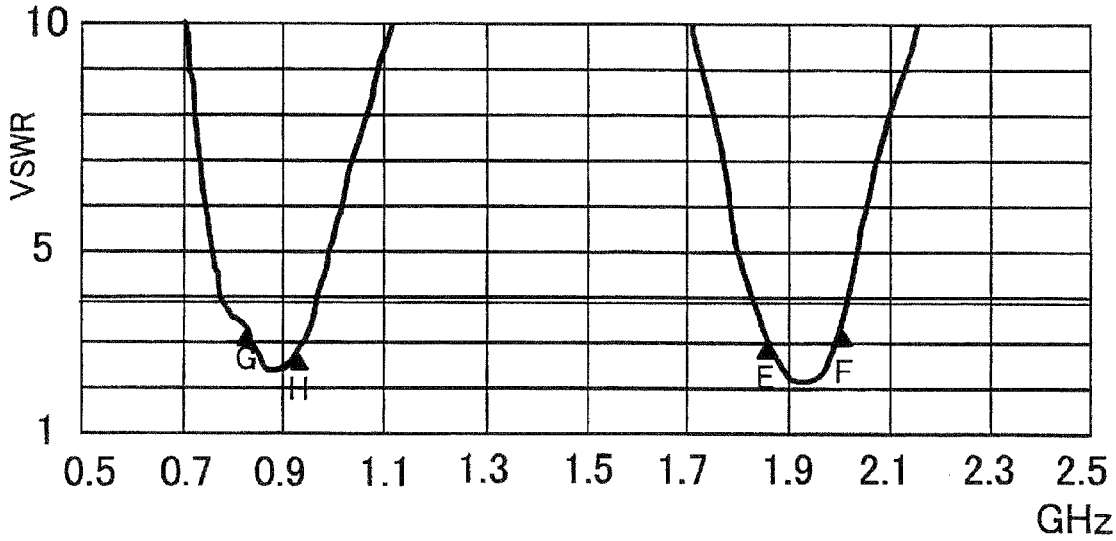
FIG. 21 is a chart of a VSWR vs. frequency characteristic of the antenna device shown in FIG. 20.

FIG. 21 is a chart of a frequency characteristic of a VSWR measured at a feed portion of the antenna device 3*d*. The first material base 30 of a model of the antenna device 3*d* used for the measurement is the same as used for the model of the antenna device 3*a* described above. The second material base 35 of the model of the antenna device 3*d* used for the measurement has relative permittivity of 15.

In FIG. 21, shown are the markers E and F which are the same as shown in FIG. 19, and two additional markers "G" and "H". The marker G (820 MHz) represents a lower limit frequency of a Japanese code division multiple access (CDMA) mobile phone system. The marker H (925 MHz) represents a lower limit frequency of the Japanese CDMA system.

As the VSWR values no greater than four in the frequency range for the Japanese CDMA system separated by the marker G and the marker H, the antenna device 3*d* satisfies the condition required to an antenna used for the Japanese CDMA system. As the VSWR values no greater than four in the frequency range for the PCS separated by the marker E and the marker F, the antenna device 3*d* satisfies the condition required to an antenna used for the PCS.

The antenna device 3*d* may tune the fundamental wave characteristic and the harmonic wave characteristic to the Japanese CDMA system and the PCS, respectively, by arranging the second material base 35 close to the open end of the antenna element 32 and selecting a permittivity value of the second material base 35.

Figure 22:
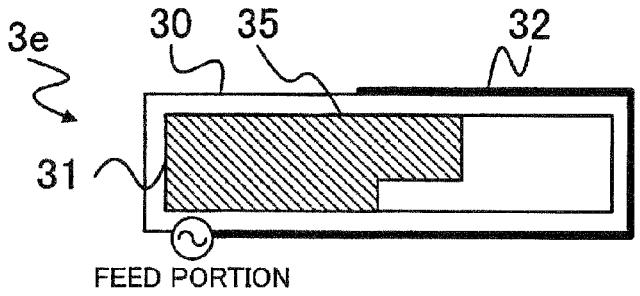
FIG. 22 is a front view of an antenna device modified from the antenna device of the third embodiment by having the second material base loaded from near the feed portion to near the open end of the antenna element.

FIG. 22 is a front view of an antenna device 3*e* to show a configuration of the antenna device 3*e* as in FIG. 12A. The antenna device 3*e* has been modified from the antenna device 3 by having the second material base 35 at a location and of a size in a way that the second material base 35 is loaded from near the feed portion to near the open end of the antenna element 32. Each of portions of the antenna device 3*e* which is a same as the corresponding one of the antenna device 3 is given a same reference numeral.

Figure 23:
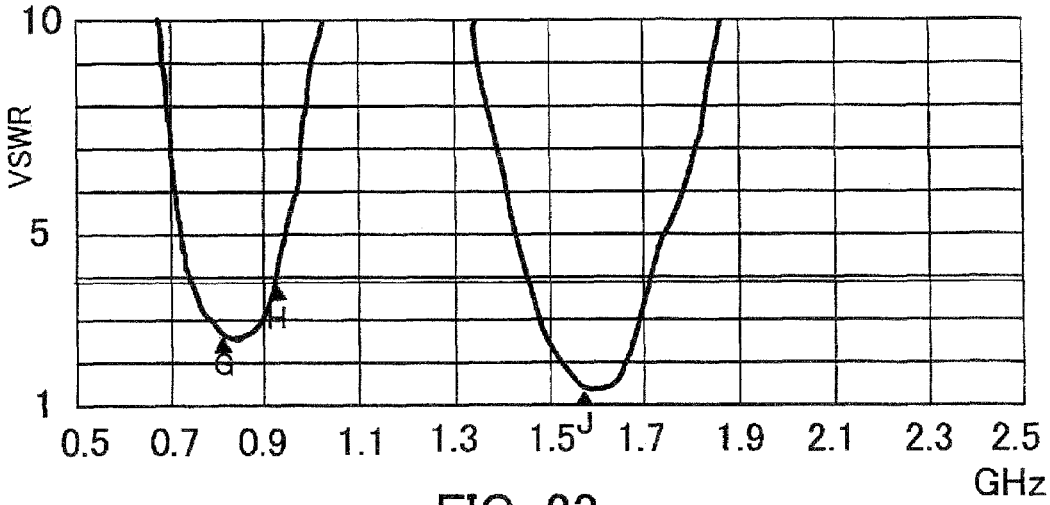
FIG. 23 is a chart of a VSWR vs. frequency characteristic of the antenna device shown in FIG. 22.

FIG. 23 is a chart of a frequency characteristic of a VSWR measured at a feed portion of the antenna device 3*e*. The first material base 30 of a model of the antenna device 3*d* used for the measurement is the same as used for the model of the antenna device 3*a* described above. The second material base 35 of the model of the antenna device 3*e* used for the measurement has relative permittivity of 15.

In FIG. 23, shown are the markers G and H which are the same as shown in FIG. 21, and an additional marker "J". The marker J (1575 MHz) represents a frequency used for the Global Positioning System (GPS).

As the VSWR values no greater than four in the frequency range for the Japanese CDMA system separated by the marker G and the marker H, the antenna device 3*e* satisfies the condition required to an antenna used for the Japanese CDMA system. As the VSWR values no greater than four at the frequency indicated by the marker J, the antenna device 3*e* satisfies the condition required to an antenna used for the GPS.

The antenna device 3*e* may tune the fundamental wave characteristic and the harmonic wave characteristic to the Japanese CDMA system and the GPS, respectively, by selecting the location and the size of the second material base 35 in a way that the second material base 35 is loaded from near the feed portion to near the open end of the antenna element 32, and selecting a permittivity value of the second material base 35.

Figure 24:
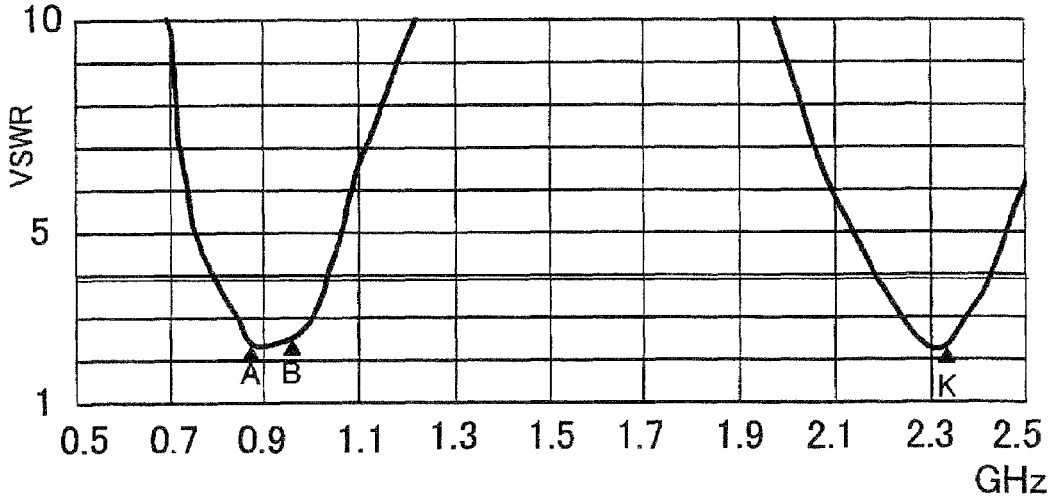
FIG. 24 is a chart of a VSWR vs. frequency characteristic of an antenna device modified from the antenna device shown in FIG. 14 for which a length and a shape of the antenna element have been modified.

FIG. 24 is a chart of a frequency characteristic of a VSWR measured at a feed portion of an antenna device modified from the antenna device 3*a* (the modification without the second material base) for which a length and a shape of the antenna element 32 have been modified. In FIG. 24, shown are the markers A and B which are the same as shown in FIG. 15, and an additional marker "K". The marker K (2327 MHz) represents a frequency around a 2.4 GHz band of a wireless local area network (WLAN) or a frequency band of Blue-tooth.

As the VSWR values no greater than four in the frequency range for the GSM separated by the marker A and the marker B as shown in FIG. 24, the antenna device modified from the antenna device 3*a* satisfies the condition required to an antenna used for the GSM. As shown in FIG. 24, however, a resonance characteristic of a harmonic wave indicated by the marker K may overlap the frequency bands of other systems described above, thus causing interference.

Figure 25:
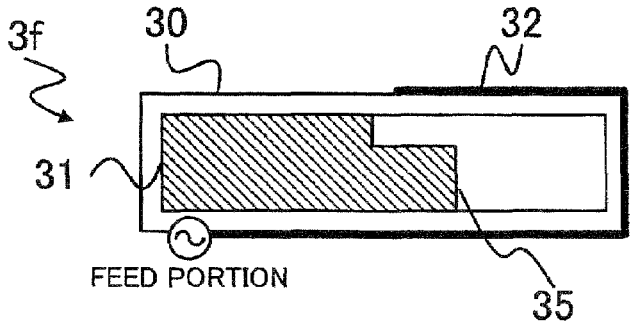
FIG. 25 is a front view of an antenna device modified from the antenna device of the characteristic shown in FIG. 24 by having the second material base loaded to fill a portion of an opening of the first material base close to the feed portion except near the open end of the antenna element.

FIG. 25 is a front view of an antenna device 3*f* modified from the antenna device of the characteristic shown in FIG. 24 by having the second material base 35 at a location and of a size in a way that the second material base 35 is loaded to fill a portion of the opening 31 close to the feed portion except near the open end of the antenna element 32. In FIG. 25, shown is a configuration of the antenna device 3*f* as in FIG. 12A in contrast with the modification without the second material base 35 of the frequency characteristic shown in FIG. 24.

Figure 26:
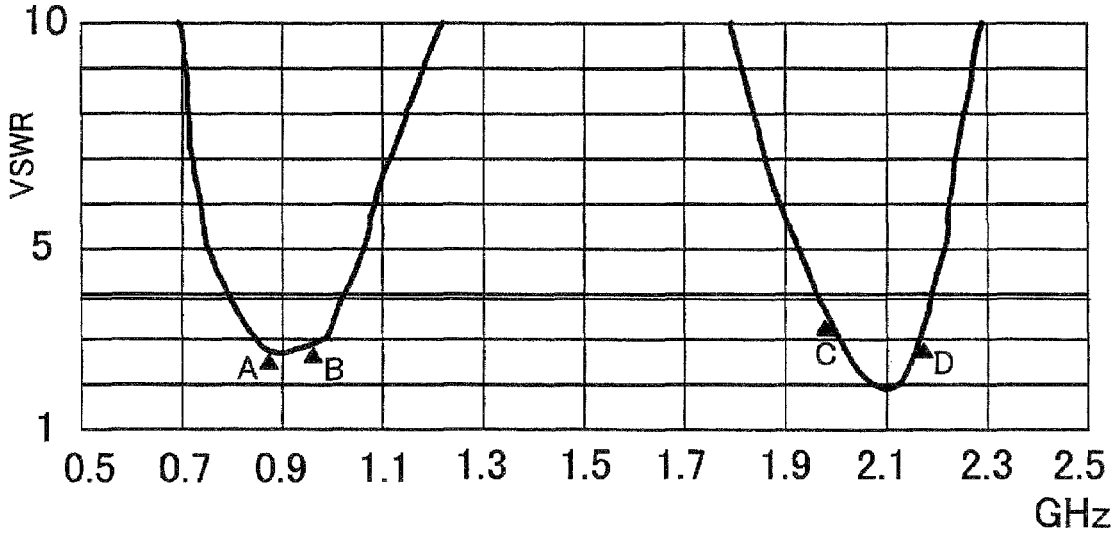
FIG. 26 is a chart of a VSWR vs. frequency characteristic of the antenna device shown in FIG. 25.

FIG. 26 is a chart of a frequency characteristic of a VSWR measured at a feed portion of the antenna device 3*f*. The first material base 30 of a model of the antenna device 3*f* used for the measurement is the same as used for the model of the antenna device 3*a* described above. The second material base 35 of the model of the antenna device 3*f* used for the measurement has relative permittivity of 15.

In FIG. 26, shown are the markers A, B, C and D which are the same as shown in FIG. 15. As the VSWR values no greater than four in the frequency range for the GSM separated by the marker A and the marker B, the antenna device 3*f* satisfies the condition required to an antenna used for the GSM. As the VSWR values no greater than four in the frequency range for the UMTS separated by the marker C and the marker D, the antenna device 3*f* satisfies the condition required to an antenna used for the UMTS.

Although satisfying the condition required to an antenna for the GSM at a resonant frequency of the fundamental wave of the antenna element 32, the modification of the characteristic shown in FIG. 24 may possibly interfere with the other systems (e.g., WLAN or Blue-tooth) at a resonant frequency of the harmonic wave. The antenna device 3*f*, meanwhile, may tune the fundamental wave characteristic to the GSM, and may not only avoid interference but tune the harmonic wave characteristic to the UMTS, by being loaded with the second material base 35 to fill the portion of the opening 31 close to the feed portion except for the portion near the open end of the antenna element 32, and by selecting a permittivity value of the second material base 35.

In the descriptions of the above embodiments, each of the shapes, configurations and connections of the material bases and the antenna element, or each of the values provided as the conditions of the measurements, are exemplary only, and may be variously modified within a scope of the present invention. For instance, the shape of the material base may not be limited to a cuboid. The material base may be formed in a way that an inner portion of relatively high permittivity is confined in an outer portion of relatively low permittivity and thus made invisible from outside.

The particular hardware or software implementation of the present invention may be varied while still remaining within the scope of the present invention. It is therefore to be understood that within the scope of the appended claims and their equivalents, the invention may be practiced otherwise than as specifically described herein.

What is claimed is:

1. An antenna device, comprising:

a first material base three-dimensionally formed by first dielectric material, the first material base forming an opening inside, the first material base having an antenna element arranged on a surface of the first material base; and a second material base formed by second dielectric material of relative permittivity higher than relative permittivity of the first dielectric material, the second material base arranged in the opening of the first material base.

2. The antenna device of claim 1, wherein the opening is formed in a way that a portion of the first material base is removed to outside.

3. The antenna device of claim 1, wherein the antenna element has an open end, and the second material base is arranged close to the open end of the antenna element.

4. The antenna device of claim 1, wherein the first material base has an additional antenna element arranged on the surface of the first material base, the additional antenna element configured to be fed in common with the antenna element, the additional antenna element having another open end, the second material base is arranged close to the open end of the antenna element, and the second material base is arranged apart from the open end of the additional antenna element.

5. The antenna device of claim 1, further comprising a third material base formed by third dielectric material of relative permittivity higher than the relative permittivity of the first dielectric material and different from the relative permittivity of the second dielectric material, the third material base arranged in the opening of the first material base.

6. The antenna device of claim 1 made by a process comprising the steps of forming the first material base and the second material base, removing a portion of the first material base to outside so as to form the opening, plating the antenna element on the surface of the first material base, and inserting the second material base into the opening.

7. The antenna device of claim 1 made by a process comprising the steps of forming the first material base and the second material base, removing the portion of the first material base to outside so as to form the opening, sticking the antenna element to the surface of the first material base, and inserting the second material base into the opening.

8. An antenna device, comprising:

a first material base three-dimensionally formed by first dielectric material, the first material base forming a first opening and a second opening inside, the first material base having a first antenna element arranged on a surface of the first material base, the first material base having a second antenna element arranged on the surface of the first material base;

a second material base formed by second dielectric material of relative permittivity higher than relative permittivity of the first dielectric material, the second material base arranged in the first opening of the first material base; and a third material base formed by third dielectric material of relative permittivity higher than the relative permittivity of the first dielectric material and different from the relative permittivity of the second dielectric material, the third material base arranged in the second opening of the first material base.

9. The antenna device of claim 8, wherein the first opening is formed in a way that a portion of the first material base is removed to outside.

10. The antenna device of claim 8, wherein the first antenna element has a first open end, the second antenna element has a second open end, the second material base is arranged close to the first open end of the first antenna element, and the third material base is arranged close to the second open end of the second antenna element.

11. The antenna device of claim 10, wherein the second material base is arranged apart from the second open end of the second antenna element, and the third material base is arranged apart from the first open end of the first antenna element.

12. The antenna device of claim 8 made by a process comprising the steps of forming the first material base, the second material base and the third material base, removing a first portion and a second portion of the first material base to outside so as to form the first opening and the second opening, respectively, plating the first antenna element and the second antenna element on the surface of the first material base, and inserting the second material base and the third material base into the first opening and the second opening, respectively.

13. The antenna device of claim 8 made by a process comprising the steps of forming the first material base, the second material base and the third material base, removing a first portion and a second portion of the first material base to outside so as to form the first opening and the second opening, respectively, sticking the first antenna element and the second antenna element to the surface of the first material base, and inserting the second material base and the third material base into the first opening and the second opening, respectively.

14. An antenna device, comprising:

a first material base three-dimensionally formed by first dielectric material, the first material base forming an opening inside, the first material base having an antenna element arranged on a surface of the first material base; and a second material base formed by second dielectric material of relative permittivity higher than relative permittivity of the first dielectric material, the second material base arranged at a selectable portion of the opening of the first material base.

15. The antenna device of claim 14, wherein the opening is formed in a way that a portion of the first material base is removed to outside.

16. The antenna device of claim 14, wherein the antenna element has an open end and a feed portion, and the opening is formed in a way that the second material base is selectively arranged close to one of the open end and the feed portion of the antenna element.

17. The antenna device of claim 14 made by a process comprising the steps of forming the first material base and the second material base, removing a portion of the first material base to outside so as to form the opening, plating the antenna element on the surface of the first material base, and arranging the second material base at the selectable portion of the opening of the first material base.

18. The antenna device of claim 14 made by a process comprising the steps of forming the first material base and the second material base, removing a portion of the first material base to outside so as to form the opening, sticking the antenna element to the surface of the first material base, and arranging the second material base at the selectable portion of the opening of the first material base.

* * * * *